US006419184B1

(12) United States Patent
Oppmann et al.

(10) Patent No.: US 6,419,184 B1
(45) Date of Patent: Jul. 16, 2002

(54) WOODEN SPOOL HELD TOGETHER WITH NOVEL TIE ROD ASSEMBLY AND METHOD OF ASSEMBLING THE SAME BETWEEN A PAIR OF DIES

(75) Inventors: Ewald A. Oppmann, Belvidere; Richard L. Peterson, Roscoe; Walter P. Pietruch, Belvidere; Richard E. Guzzardo, Freeport, all of IL (US)

(73) Assignee: J. L. Clark, Inc., Rockford, IL (US)

( * ) Notice: Subject to any disclaimer, the term of this patent is extended or adjusted under 35 U.S.C. 154(b) by 14 days.

(21) Appl. No.: 09/586,667

(22) Filed: Jun. 1, 2000

(51) Int. Cl.[7] ..... B65H 75/14; B65H 75/22
(52) U.S. Cl. ..... 242/608.3; 242/610.4
(58) Field of Search ..... 242/608.3, 118.6, 242/118.61, 118.62, 118.7, 610.4; 411/511, 517, 521

(56) References Cited

U.S. PATENT DOCUMENTS

| | | | | | |
|---|---|---|---|---|---|
| 1,333,162 | A | * | 3/1920 | Cook | 242/608.3 |
| 2,330,131 | A | * | 9/1943 | Markle | 242/608.3 |
| 2,741,442 | A | * | 4/1956 | Aupperle | 242/118.6 |
| 2,856,137 | A | * | 10/1958 | Howsam | 242/118.7 |
| 3,036,793 | A | * | 5/1962 | Becker | 242/118.6 |
| 3,319,508 | A | * | 5/1967 | McCormick | 411/517 |
| 3,383,070 | A | * | 5/1968 | Feaster | 242/118.6 |
| 3,619,478 | A | * | 11/1971 | Staiger | 411/517 |
| 3,940,086 | A | * | 2/1976 | Stoquelet | 242/118.6 |
| 3,981,400 | A | * | 9/1976 | Quintana | 242/118.61 |
| 4,189,823 | A | * | 2/1980 | Neyenhuys | 242/118.6 |
| 4,834,603 | A | * | 5/1989 | Holton | 411/517 |
| 6,164,588 | A | * | 12/2000 | Jacobsen | 242/608.4 |

OTHER PUBLICATIONS

Badger Plug web p. (2 pages).

* cited by examiner

*Primary Examiner*—John M. Jillions
(74) *Attorney, Agent, or Firm*—Leydig, Voit & Mayer, Ltd.

(57) ABSTRACT

A wooden spool held together with a novel tie rod assembly and a method of assembly the spool between a pair of dies. The novel tie rod assembly includes elongate tie rods having a bent end or otherwise deformed first end and a plurality of grooveless retaining rings. The tie rods are inserted through the end flanges and the transverse barrel of the of the spool. The retaining rings are pressed axially on the smooth second ends of the tie rods which project axially from one of the flanges. The spool can be assembled between a pair of dies. The base die includes locating recesses to receive the bent ends of the tie rods and the top die includes engaging pins for pressing the retaining rings on the opposite ends of the spool.

20 Claims, 9 Drawing Sheets

FIG. 10
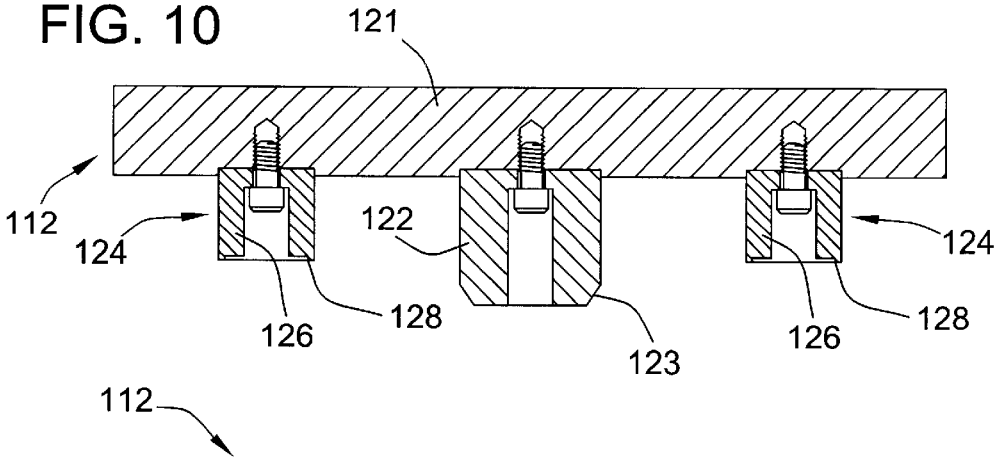
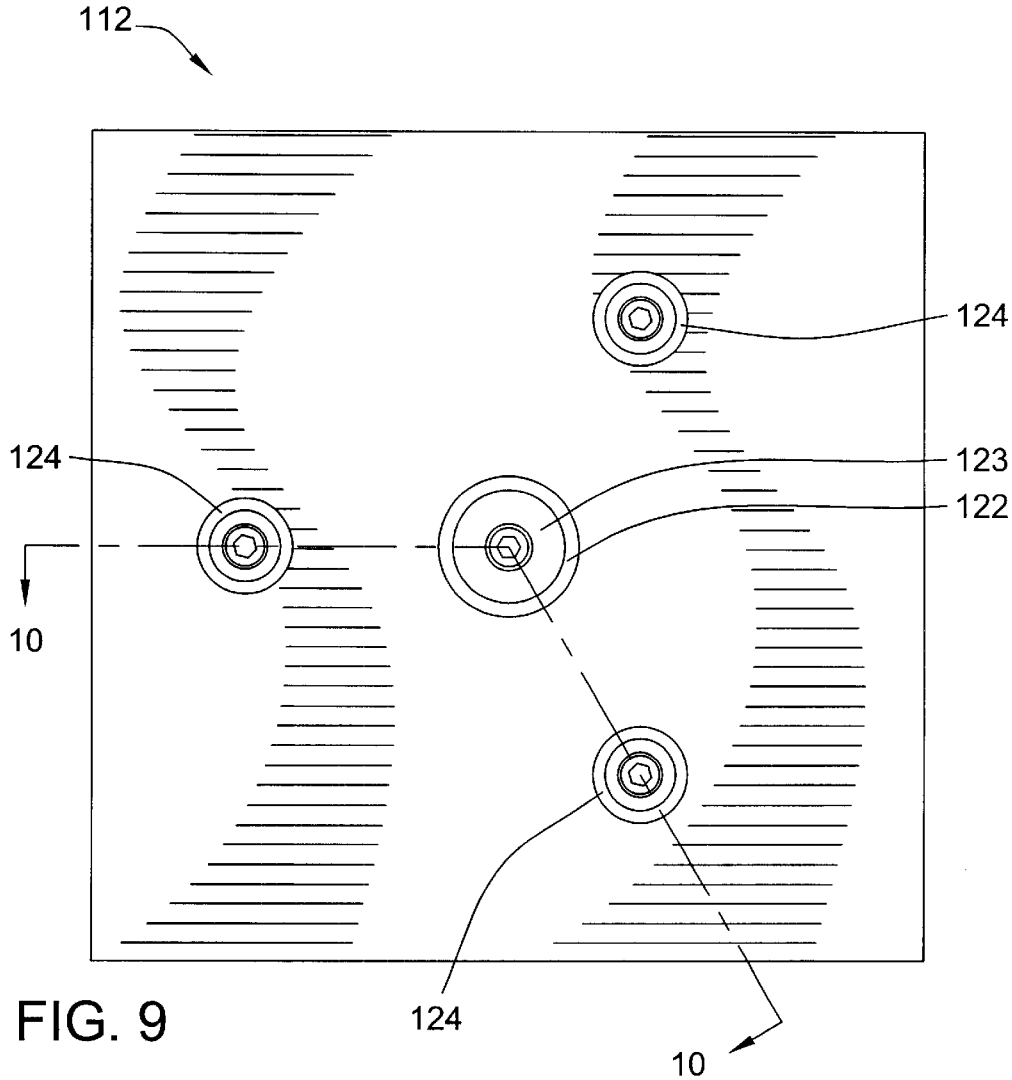
FIG. 9

WOODEN SPOOL HELD TOGETHER WITH NOVEL TIE ROD ASSEMBLY AND METHOD OF ASSEMBLING THE SAME BETWEEN A PAIR OF DIES

FIELD OF THE INVENTION

The present invention relates to spools for carrying such things as wire and cable, and more particularly to primarily wooden spools which are held together by tie rod assemblies.

BACKGROUND OF THE INVENTION

Wooden spools are used to support and transport large quantities of wire, cable and other such cordage. Strength of the spool is often very important as the weight of the material carried by the spool is typically very large. As illustrated in FIG. 1, a prior art wooden spool 10 typically comprises two planar wood flanges 12 spaced apart in generally parallel relationship and a central barrel 14 extending transversely therebetween. To tie and hold these spool components together, a tie rod assembly 16 is utilized that comprises elongate bolts 18 and t-nuts 20. To assembly the spool, the ends of the barrel 14 are first received in diametrically opposed grooves 22 in the flanges. Then, the bolts 18 are inserted through diametrically opposed holes 24 in the flanges. Each bolt 18 extends through the barrel 14 and includes a threaded end 26 that projects axially outward from the outside face of one of the flanges. The t-nuts 20 are pressed into the wood and the bolts are screwed into the t-nuts until each t-nut 20 engages the adjacent flange and the hexagonal head 28 of each bolt firmly engages the other flange coacting against the t-nut.

The prior art spool illustrated in FIG. 1 has worked satisfactorily for many years and is well accepted in the industry. However, it will be appreciated by those skilled in the art, that the spool can comprise a noticeable portion of the overall cost of producing a sellable spool of wire. The reason is that the wire carried by the spool may be a relatively inexpensive material which makes it desirable to provide an inexpensive spool. As will be readily appreciated by those skilled in the art when viewing the present invention, the inventor of the present application has realized that there are several cost drawbacks associated with the materials and assembly method of prior art wooden spool assemblies.

SUMMARY OF THE INVENTION

It is therefore an objective of the present invention to reduce the raw material costs associated with the tie rod assemblies for wooden spools.

It is another objective of the present invention to provide a more cost efficient way to assemble a wooden spool.

It is another objective of the present invention to accomplish the above objectives while maintaining or possibly improving the satisfactory strength characteristics of prior art wooden spools.

In accordance with these and other objectives, the present invention is directed towards a less costly spool that comprises a pair of spaced apart end flanges, a barrel transversely between the flanges, and a novel and less expensive tie rod assembly. The novel tie rod assembly includes a plurality of rods that have a bent end or otherwise deformed or enlarged end, and a plurality of retaining rings that are pressed axially on the other ends of the rods. Suitable retaining rings include those with axially offset inner and outer circular edges with a curved cross section therebetween.

There are several advantages of the novel tie rod assembly. One advantage is that formed threading is not necessary in the ends of the tie rods. This provides for inexpensive raw materials as the costly step of forming threads into the ends of the tie rods can be eliminated. The present invention also provides for an easier assembly operation as rotation of the nuts or the tie rod is not necessary during spool assembly. Because no rotation is needed, a hexagonal head at the other end does not need to be formed, thereby also reducing material costs of the tie rods. A further advantage that is achieved when using the preferred method of assembly is that the retaining rings can be pressed into the wood material of the flanges such that the retaining rings are maintained in tight constant engagement with the corresponding flange, which in turn, causes the inner edges of the retaining rings to apply continuous gripping pressure against the outer diameter of the tie rods.

The present invention is also directed toward a new method of assembling a wooden spool. According to the new method, a wooden spool assembly including the novel tie rod assembly is placed between two pressing dies, with the retaining rings yet to be pressed on the free ends of the tie rods. According to the method, the bent or otherwise enlarged ends of the tie rods are received in locating recesses in the base die. The top die includes engaging pins aligned with the locating recesses for pressing the retaining rings on the free ends of the tie rods. The dies are moved axially together to axially press the retaining rings on the free ends of the tie rods. During pressing, the dies are translated axially preferably until the spool is in slight axial compression between dies. When released, the upper wooden flange of the spool engages outer peripheral edge of the retaining rings which in turn causes the inner peripheral edges of the retaining rings to apply radially inward force on the respective tie rods. This advantageously provides a desirable strength feature and prevents slack between the barrel and the flanges. This also achieves an easier assembly operation.

Other object and advantages of the invention will become more apparent from the following detailed description when taken in conjunction with the accompanying drawings.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIGS. 9 and 10 are plan and cross-sectional views of a top die used to assemble the spool of FIGS. 2 and 3.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
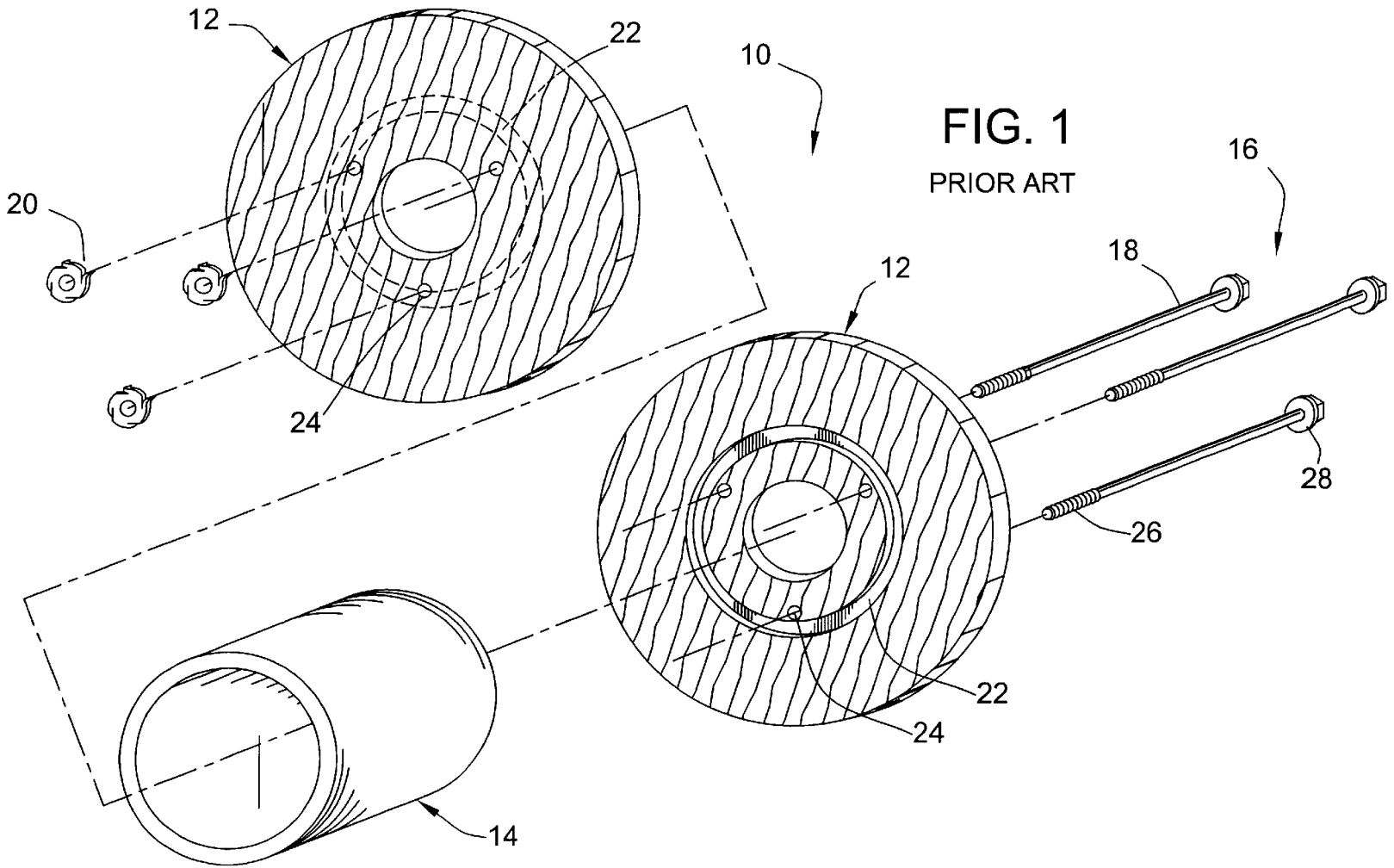
FIG. 1 PRIOR ART
FIG. 1 is an exploded assembly view of a prior art wooden spool that exemplifies the prior art.
Figure 2:
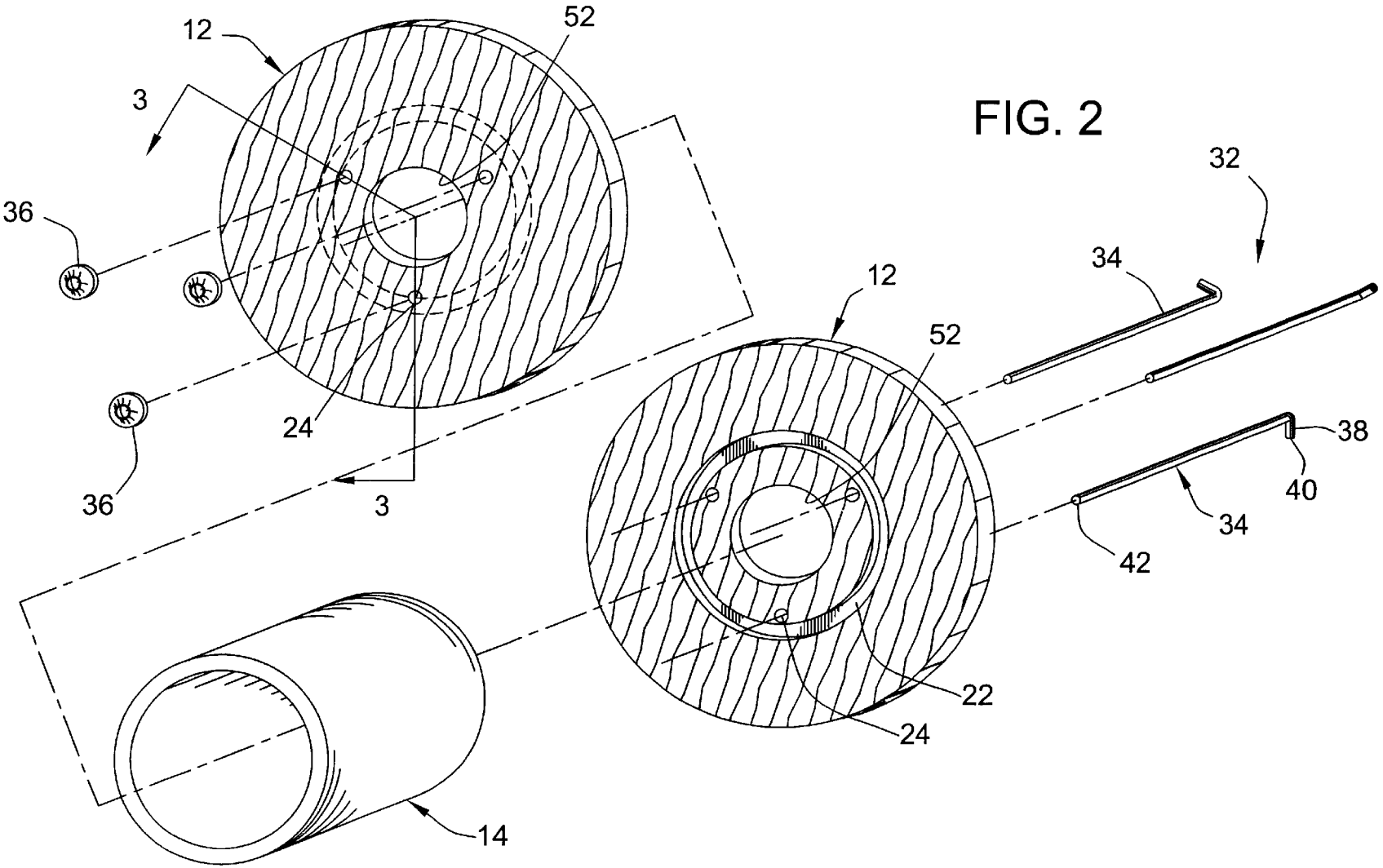
FIG. 2 is a exploded assembly view of a wooden spool incorporating the novel tie rod assembly according to a preferred embodiment of the present invention.
Figure 3:
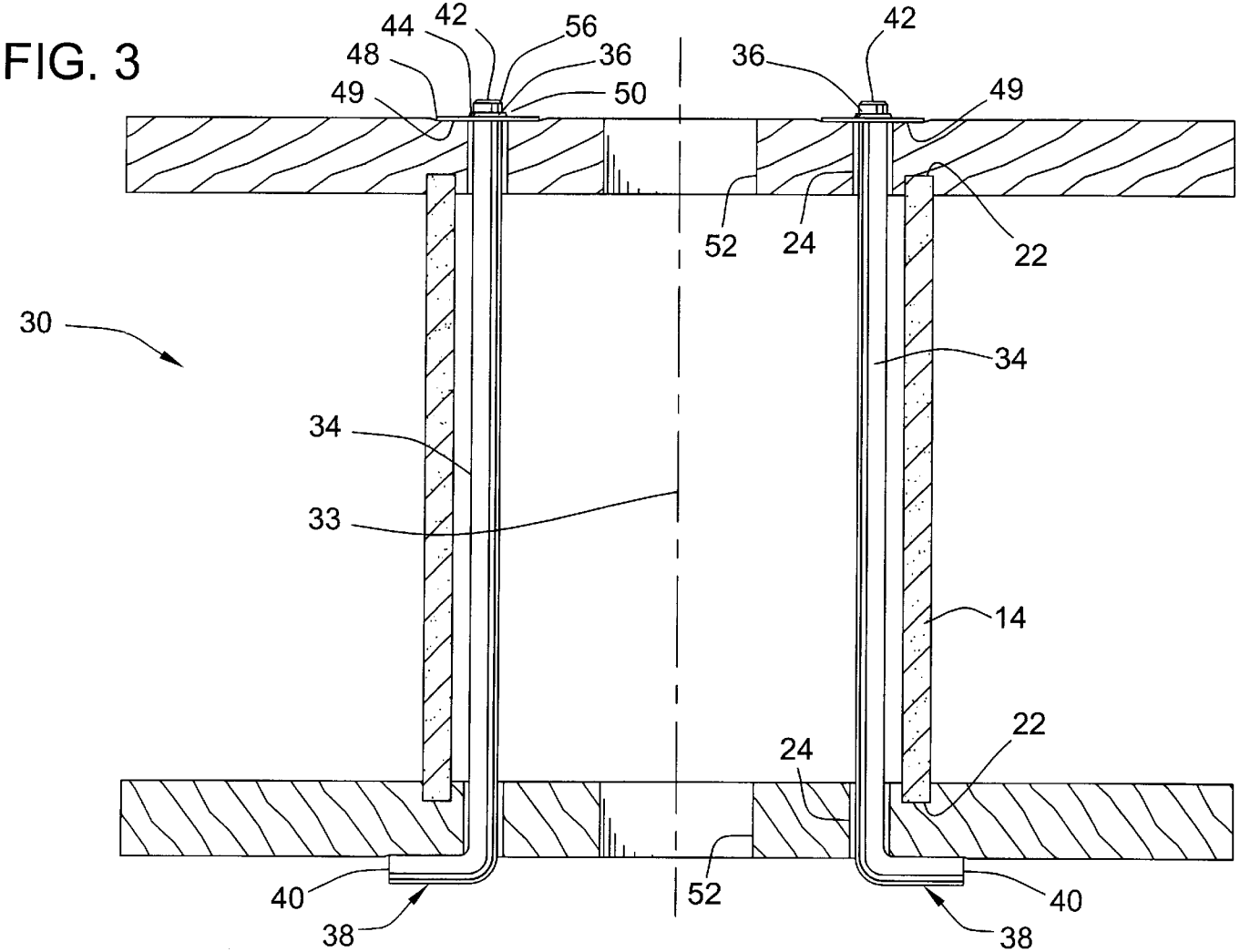
FIG. 3 is a cross sectional view of a wooden spool assembled from the components illustrated in FIG. 2.
Figure 5:
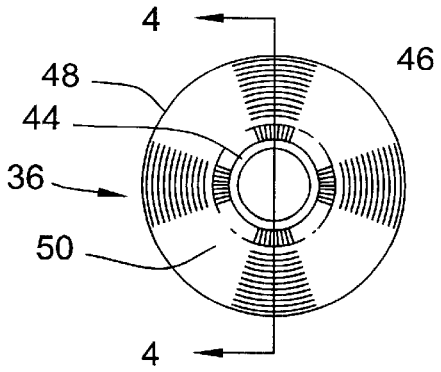
FIG. 5 is an end view of a retaining ring illustrated in FIG. 4.
Figure 5A:
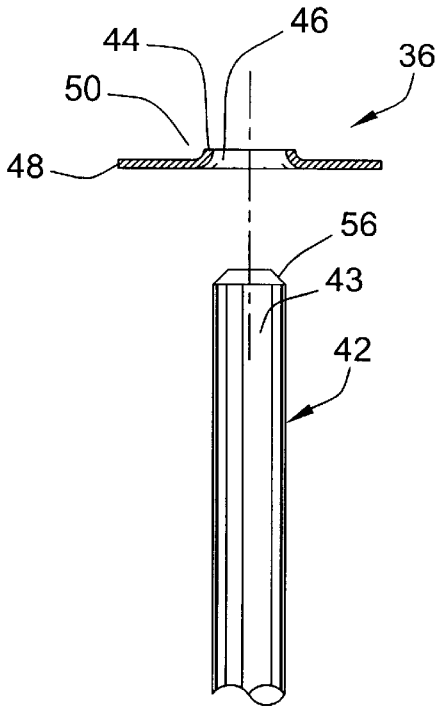
FIG. 5*a* is an isometric view of the retaining ring shown in FIG. 5.
Figure 5A:
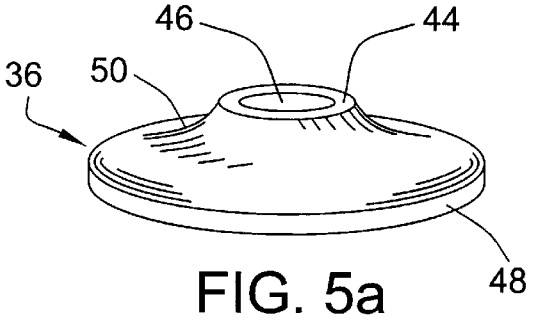
Figure 4:
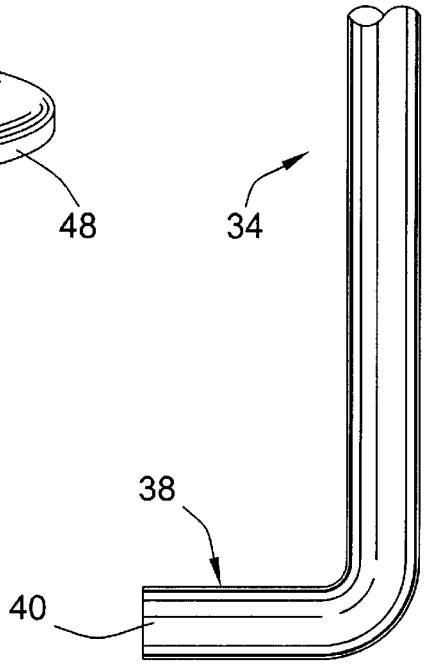
FIG. 4 is a enlarged side cross sectional view of a retaining ring and a bent rod used in the spool of FIGS. 2 and 3.

Referring to FIGS. 2–4, a wooden spool 30 incorporating a novel tie rod assembly 32 is illustrated according to a preferred embodiment of the present invention. Similar to the prior art wooden spool of FIG. 1, the wooden spool 30 of FIG. 2 includes certain conventional components including a pair of generally parallel spaced apart end flanges 12 and a cylindrical barrel 14 extending transversely therebetween, coaxial about a spool axis 32. The end flanges 12 include diametrically opposed receiving grooves 22 that closely receive the opposed cylindrical ends of the barrel 14. The conventional materials preferably used in the spool include wood for the end flanges 12 and spiral wound fiber board for the barrel 14. However, it will be appreciated that other materials such as plastic, fiber board or other suitable materials can be used for the end flanges 12 and wood, plastic, metal or other suitable materials can be used for the central barrel 14, without departing from scope of the present invention as defined by the appended claims.

Figure 6:
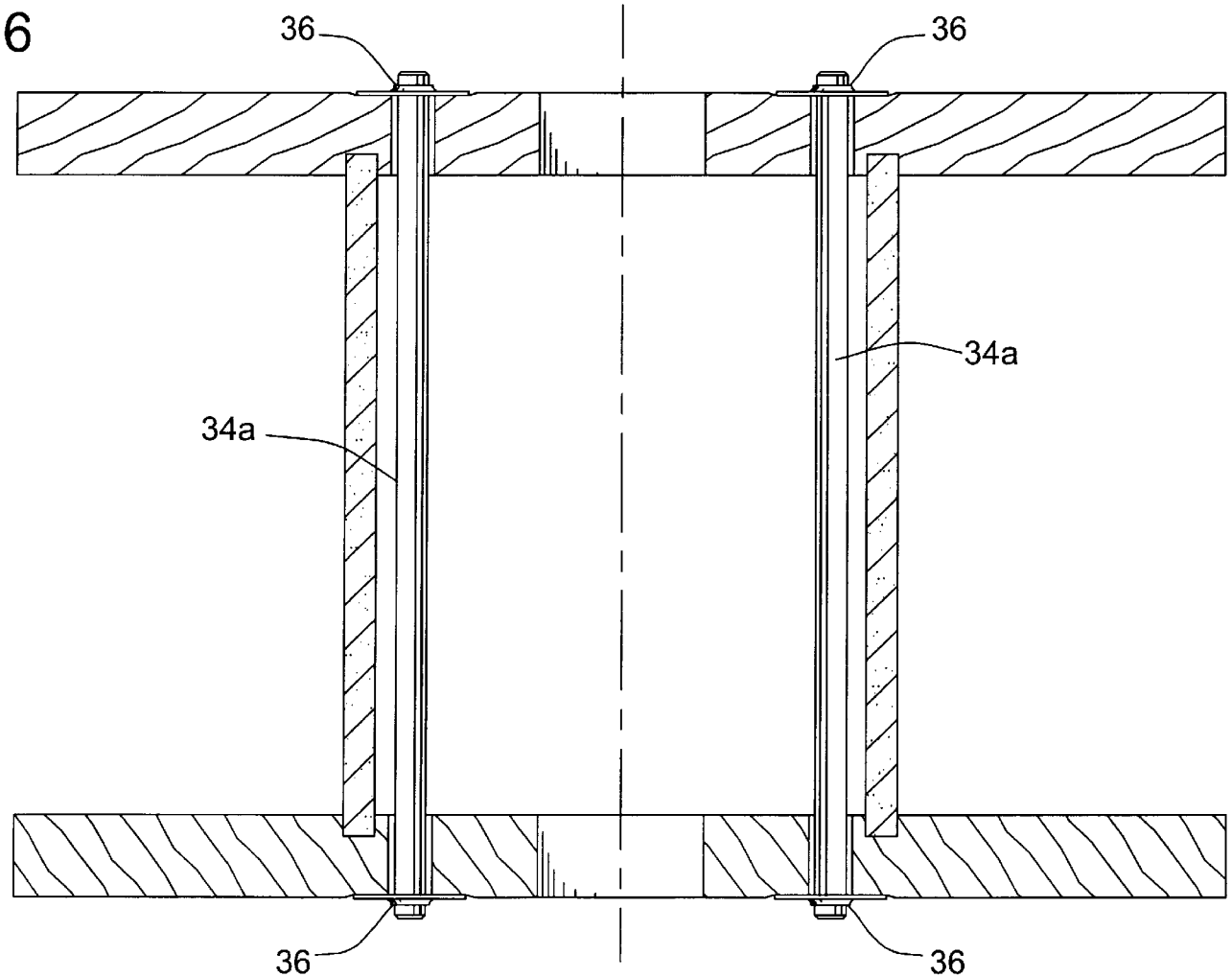
FIG. 6 is a cross sectional view of a wooden spool according to an alternative embodiment.
Figure 7:
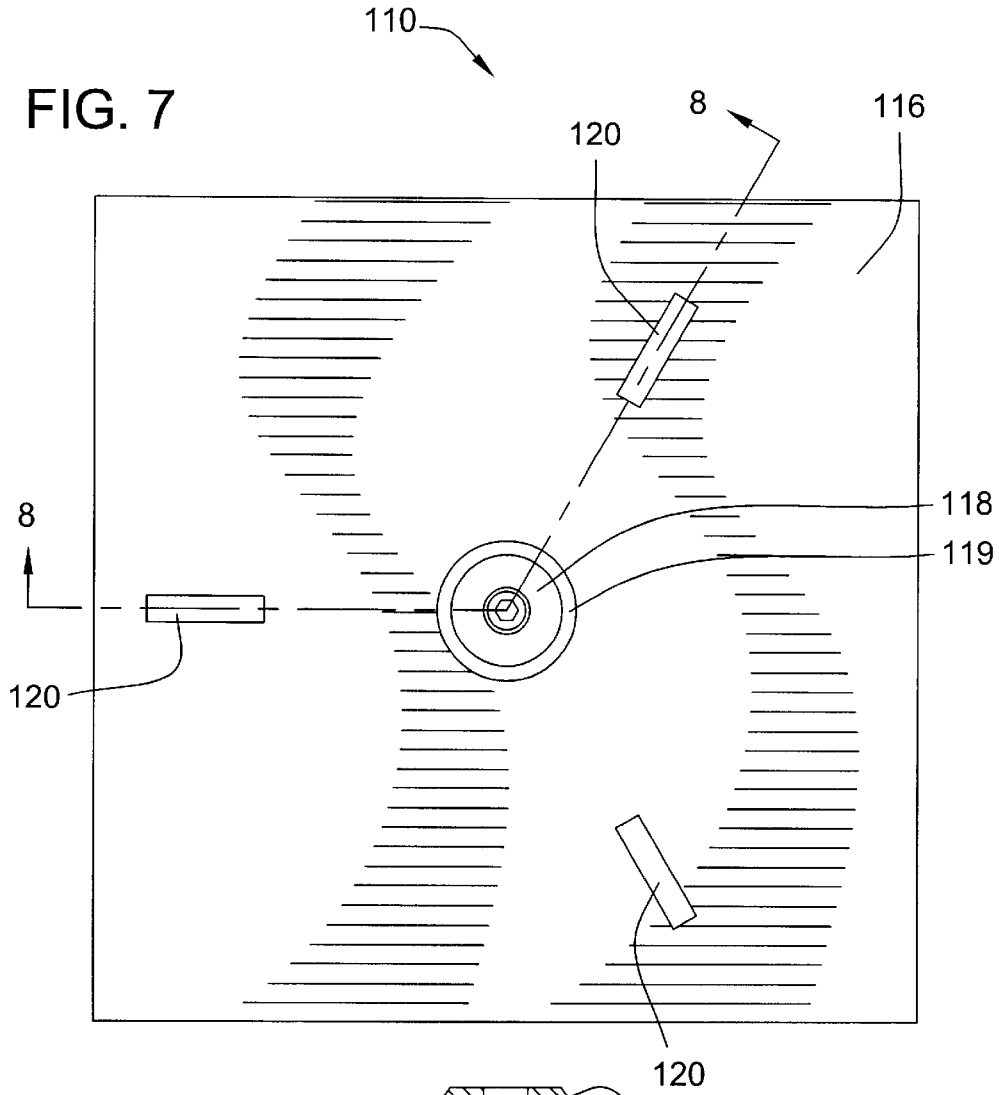
FIGS. 7 and 8 are plan and side views of a base die used to assemble the spool of FIGS. 2 and 3.
Figure 8:
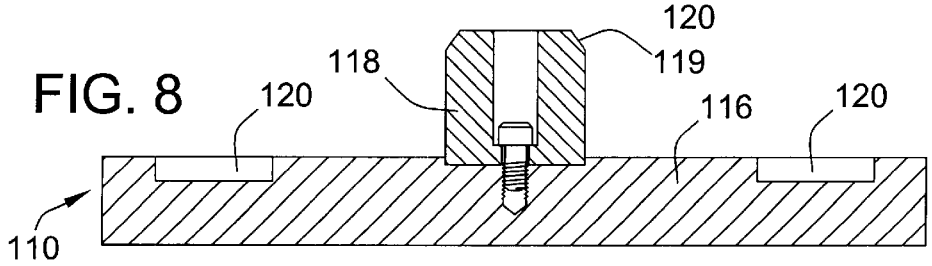

The wooden spool of FIG. 2 departs from the prior art by providing the novel and less expensive tie rod assembly 32 for securing and tying the spool 30 together. In the preferred embodiment, the novel tie rod assembly 32 includes multiple steel tie rods 34 and grooveless retaining rings 36. The tie rods 34 are inserted through diametrically opposed holes 24 in the end flanges 12 and through the hollow center of the cylindrical barrel 14. Each tie rod 34 has a retention structure in the form of an enlarged first end 38 sized greater than its corresponding hole in the end flange. The enlarged first end 38 engages the associated flange 12 for axial retention of the tie rod 34 in one axial direction. In the preferred embodiment, the enlarged first end 38 is provided by a bent end 40 that extends generally perpendicular to the rest of the rod 34. The bent end 40 provides an inexpensive way to manufacture the tie rods while at the same time easily ensuring that several formed rods are of same length. However, it will be appreciated that other deformed ends of the rod may also be used to provide the retention structure. In addition, retention structures or enlarged first ends 38 of the tie rods 34 may be provided without deformation of the end, for example, by another set of grooveless retaining rings 36 as is illustrated in the alternative embodiment of FIG. 6 which may be preassembled or die assembled, or by welding and the like. In this alternative embodiment, the tie rods 34*a* are straight and do not require any further forming after rod cutting operations.

Referring again to the first embodiment and FIG. 2, the second end 42 of each tie rod 34 extends past the outside surface of the other end flange 12 for receiving a steel retaining ring 36. As shown, the second end 42 does not need the provision of costly formed threading as required in prior art spools, but instead may have a non-threaded generally smooth outer surface 43 (FIG. 4) in which no metal forming operations have been performed. The outer surface could also be roughened or notched, however, such additional operations would increase the expense of the spool. Each retaining ring 36 is axially pressed on the second end 42 of one rod 34 and coacts with the enlarged first end 38 to hold and tie the end flanges 12 and central barrel securely therebetween. As best illustrated in FIG. 4, each retaining ring 36 includes a smaller diameter circular inner peripheral edge 44 surrounding an opening 46 dimensioned closely or slightly smaller than the outer diameter of the rod 34, and an outer peripheral edge 48 axially offset from the inner peripheral edge 44. It should be noted that a continuous circular inner peripheral edge 44 as shown provides the highest possible strength for axial retention and gripping the tie rod. Although toothed retaining rings with individual teeth around the inner peripheral edge could also be used, such to toothed retaining rings are not currently preferred due to their likely tendency to bend out of position and allow axial slippage due to gaps between teeth. Other possibilities include square retaining rings or washers that retain when the end of the rod is riveted, enlarged or deformed.

In the preferred embodiments, each retaining ring 36 includes an annular arch or curved cross section 50 joining the inner and outer peripheral edges 44, 48. The significance of the curved cross section 50 is that an outward axial force applied at the outer peripheral edge 48 is translated into a radially inward pressure applied by the inner peripheral edge 44 against the outer surface of the tie rod 34. It is an advantage that this shape better ensures that the retaining rings 36 do not slip or slide off of the tie rods 34 once axially pressed thereon. For even greater strength, two retaining rings can be used per each rod.

Preferably, the retaining rings 36 are pressed on sufficiently with a force such that the retaining rings dig slightly into the wood material of the flanges 12, forming slight indentations 49 in the wood. In this manner, the tie rods 34 are maintained in a state of slight tension due to the somewhat resilient nature of the wood such that the outer peripheral edge 48 of the retaining ring 36 is in continuous engagement with the flange 12. The slightly resilient nature of the wood or other material in the flange 12 causes a continuous outward applied pressure to the retaining ring, which in turn, achieves continuous application of pressure by the inner peripheral edge 44 against the rod 34. It should also be noted that recesses could also be formed in the wooden flanges to receive the retaining rings or even to receive the bent ends of the rods (in which the rods would still project from the outside surface of the flanges). However, such recesses are not necessary and may increase the overall cost of the spool.

Figure 11:
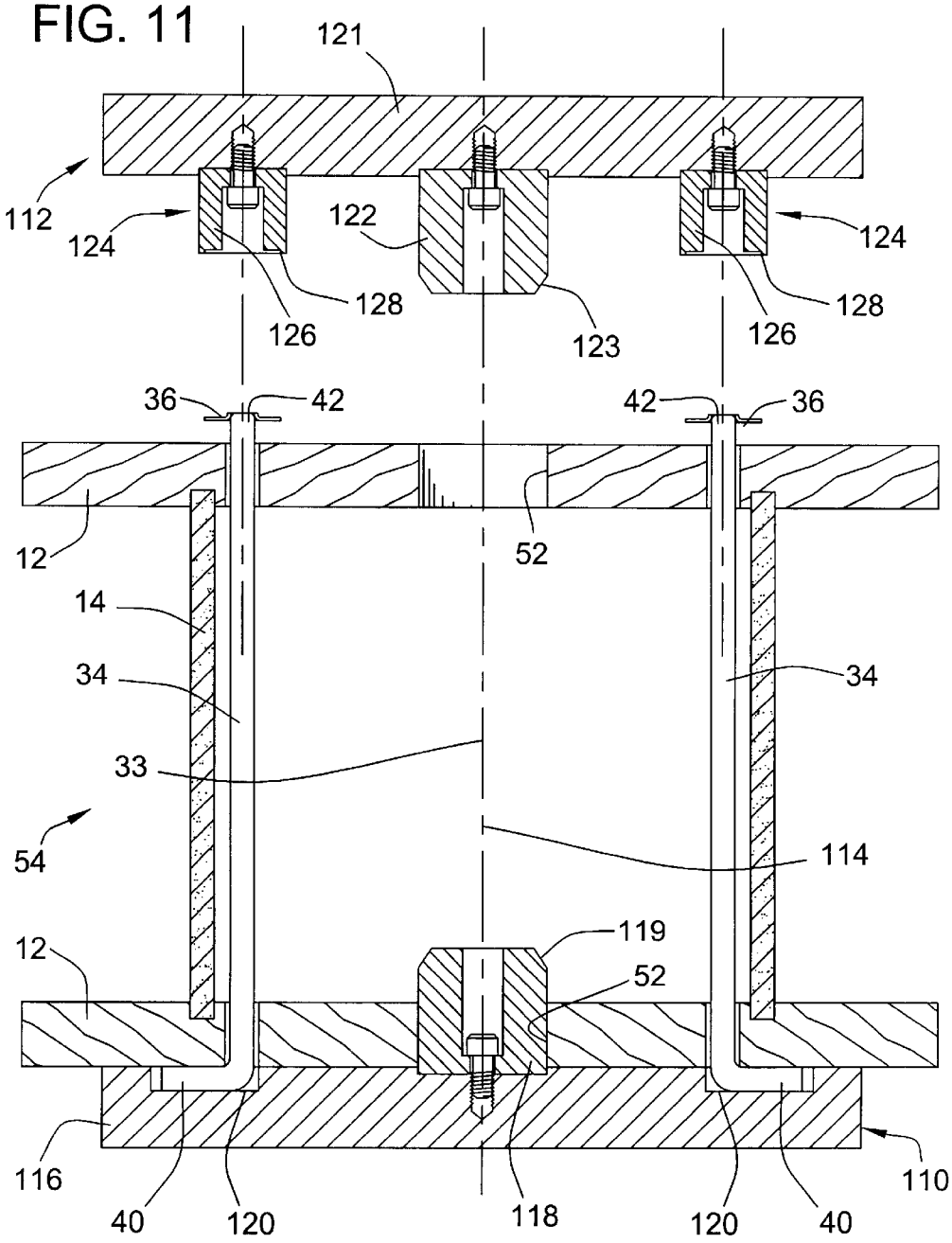
FIGS. 11 and 12 are cross sectional views of the base and top dies shown in FIGS. 8 and 10, in operation for assembling the retaining rings on the spool shown in FIGS. 2 and 3.
Figure 12:
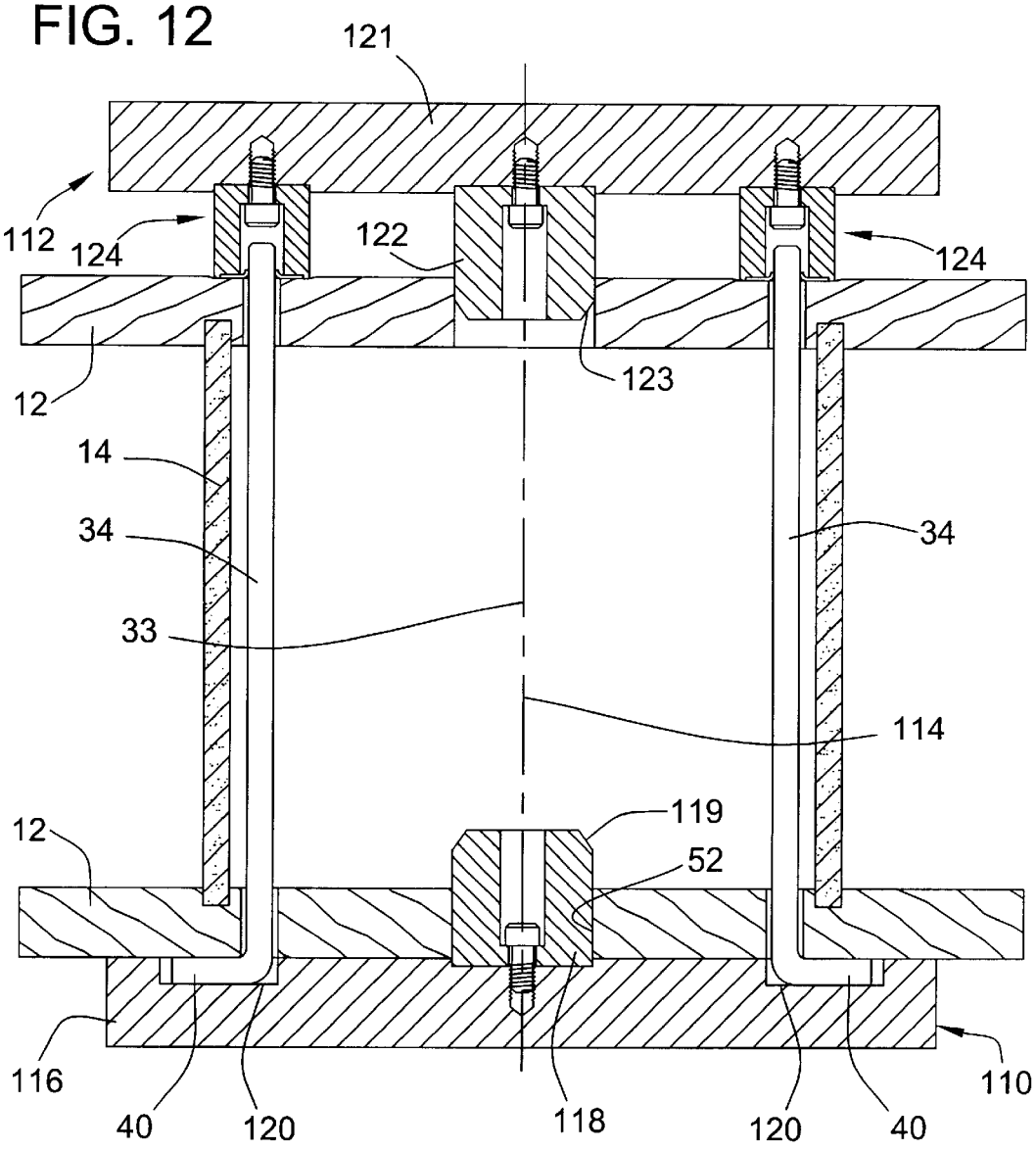

Turning to FIGS. 7–12, a novel tool for assembling the wooden spool 30 is illustrated in accordance with a preferred embodiment of the present invention. The novel spool assembly tool includes a base die 110 (FIGS. 7–8) and a top die 112 (FIGS. 9–10). As indicated in FIGS. 11–12, the dies 110, 112 are spaced apart vertically apart and adapted to be reciprocated towards and away from each other along a pressing axis 114 to facilitate pressing of the retaining rings 36 on the ends of the tie rods 34. Either or both of the dies 110, 112 may be movable towards one another by means of an actuator or press (not shown), but one of the dies is preferably fixed or stationary.

Before discussing the actual assembly process with the dies in further detail, certain structure details of the dies will first be pointed out. The base die 110 includes a baseplate 116 with a central pilot pin 118 secured thereto. The pilot pin 118 is coaxial about the pressing axis 114 and projects axially towards the top die 112. The pilot pin 118 is sized closely to diameter of the arbor holes 52 in the end flanges of the spool 30 for locating the wooden spool on the base die 110 with axial alignment between the spool axis 32 and the pressing axis 114. The pilot pin 118 preferably includes a chamfered surface 119 for guiding the pilot pin 118 into the arbor hole 52. The baseplate 116 also defines recesses 120 spaced radially about the pilot pin 118. The recesses 120 are closely sized to the bent ends 40 of the tie rods 36 to allow the bent ends 40 to be received in the recesses 120 for alignment of the spool assembly at a predetermined angular position.

The top die 112 includes a top plate 121 and also a pilot pin 122 having an outer diameter sized closely to the arbor holes 52 and projecting axially toward the base die 110. The pilot pin 122 is diametrically opposed to the pilot pin 118 of the base die 110. The pilot pin 122 of the top die 112 also includes a chamfered surface 123 and serves the same alignment and locating purposes as the pilot pin 118 for the base die 110. The top die 112 includes corresponding retaining ring engaging pins 124 projecting axially towards the base die 110. Each engaging pin 124 is generally axially aligned with the recesses 120 in the base die 110. The engaging pins 124 are axially short enough, such that the pilot pin 122 contacts the spool assembly first. Each engaging pin 124 also includes a central bore 126 sized large and deep enough to easily receive the free ends 42 of tie rods 34. Surrounding the bore 126 is an engaging surface 128 having a suitable shape and similar diameter as that of the retaining rings 36 such that the engaging pins 124 are adapted to engage the retaining rings 36 and press them on free ends 42 of the tie rods 34. The pilot pins 118, 122 and the engaging pins 124 are preferably fastened by bolts such that they can be replaced from time to time as they wear out.

With the structure details of the top and bottom dies 10, 112 now set forth above, a preferred method of assembly of the wooden spool will now be described in greater detail according to the preferred embodiment, with reference to FIGS. 2, and 11–12. The first step is positioning wooden flanges 12 on opposite ends of the barrel 14 with the cylindrical barrel ends being received into the diametrically opposed grooves 22. Second, the tie rods 34 are inserted through the diametrically opposed holes 24 in the flanges 12 and through the center of the barrel 14 to provide a partially assembled spool 54 (FIG. 11). As indicated above, each rod 34 includes a retention structure, which may take the form of a bent end 40 at one end 38. Next, the partially assembled spool 54 is arranged between the dies 110, 112 and on the base die 110 with the bent ends 40 received into the die recesses 120 and the pilot pin 118 received in the arbor hole 52. As previously indicated, this automatically sets a predetermined angular position for the spool assembly 54 in which the second ends 42 of the rod are automatically axially aligned with the engaging pins 124. The pilot pin 118 also axially aligns the spool axis 33 with the pressing axis 114. Next, retaining rings 36 are placed on the outer tips 56 of the rods 34. The tips 56 may include a chamfer 56 to provide a reliable temporary locating seat for the rings 36. Lastly, one of the dies is axially translated and actuated towards the other die to press retaining rings 36 axially on the free ends 42 of the rods 34. During this operation, the top pilot pin 122 first enters the top arbor hole 52 for even more precise alignment and then the engaging edges 128 of the engaging pins 124 axially press the retaining rings 36 on the ends 42 of the rods. The dies 110, 112 are preferably axially translated towards one another until the spool 32 is in a slight compression state such that the retaining rings 36 tend to dig into the wood material of the flanges 12 and form slight indentations 49. Then, the now fully formed spool 30 is released from the dies by retracting one of the dies axially away from the other die. It should be noted that at this point the wood material in the flange 12 may exert axially outward force on the outer peripheral edge 48 of the retaining ring 36 such that the inner peripheral edge 44 applies an even greater gripping force radially inward against the outer surface of the rod 34.

Lastly, it should be noted that the present invention is directed primarily at solving the primary cost drawback with prior wooden spools, namely that threads are required on the tie rod assemblies and that rotation of a nut on to the tie rod bolt is necessary to complete assembly. The inventor of the present invention has contemplated other less costly (as compared relative to threaded mechanisms) tie rod non-threaded retaining means for coacting with the retention structure at the first end of the tie rods for tying and holding the spool together axially, but none of these alternative structures provide all of the cost savings and other advantages of the above described embodiments in which axially pressed on retaining rings are used. For example, an alternative non-threaded retaining means may include a rod with a drill holed and/or a formed circular groove, in which a hitch pin, cotter pin, spring clip or non-threaded structure could be used to provide retention. This type of non threaded retaining means could also be provided on one or both ends of the tie rods to include providing the enlarged retention structure at the first end of the tie rod.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A spool comprising:

first and second flanges in spaced relationship, each flange having a plurality of holes, a central arbor opening and a circular receiving groove, the holes of the first flange axially aligned with the holes of the second flange, the receiving groove of the first flange in diametric opposition with the receiving groove of the second flange, the holes being arranged radially about the central opening between the receiving groove and the central opening;

a plurality of rods, one for each set of axially aligned holes, each rod extending through one set of holes in the flanges, each rod having an enlarged first end sized greater than its corresponding hole in the first flange, and a non-threaded second end projecting from the second flange;

a cylindrical barrel transversely between the flanges, the ends of the cylindrical barrel being received in the receiving grooves of the respective flanges;

a plurality of retaining rings, one retaining ring axially pressed on the second end of each rod, each retaining ring including an inner peripheral edge engaging the rod and a larger diameter outer peripheral edge axially offset from the inner peripheral edge, the retaining ring having a body with a curved cross section between the inner and outer peripheral edges; and wherein the second ends of the rods project axially beyond the entire body of the retaining rings such that the second ends are not substantially flush with an outside face of the second flange and are not contained within the body of the retaining rings.

2. The spool of claim 1 wherein the retaining rings are pressed into the flanges forming an indentation therein such that one of the flanges applies an outward axial force to the outer peripheral edge of the retaining ring, the outward axial force being carried by the inner peripheral edge of the retaining ring supported against the outer surface of the rod, the curved cross section of the retaining ring translating the axial force into a radially inward force applied by the inner peripheral edge.

3. The spool of claim 1 further comprising a chamfered surface on the second ends of the rods for providing a temporary seating surface for locating the retaining rings during initial assembly.

4. The spool of claim 1 wherein the first end of the rod is deformed to provide the enlarged structure.

5. The spool of claim 4 wherein the first end of the rod is bent substantially perpendicular to the rest of the rod.

6. The spool of claim 1 wherein a plurality of retaining rings are pressed on the first ends of the rods to provide the enlarged structure.

7. The spool of claim 1 wherein the flanges are manufactured from a material selected from the group consisting of wood, fiber board, and plastic, the barrel is manufactured from a material selected from the group consisting of wood, fiber board, plastic and metal, and the rods are metal.

8. The spool of claim 1 wherein the inner peripheral edge is continuously circular without teeth in engagement with the tie rod, and the outer cylindrical surface of the second end of each rod is smooth.

9. The spool of claim 1 wherein the rods substantially fill the holes of the second flange such that the retaining rings are disposed entirely outside of the holes of the second flange and do not occupy any space of the holes of the second flange.

10. A spool comprising:

a pair of spaced apart flanges;

a plurality of elongate rods, each rod extending through the flanges to include a first end on the outside surface of one flange and a non-threaded second end on the outside surface of the other flange, the first ends of the rods including an enlarged structure to engage the flange and provide for axial retention of the rods at the first end;

a barrel surrounding the rods transversely between the inside surfaces of the flanges;

a plurality of retaining rings, each retaining ring engaging the second end of one of the rods for retention of the rods; and wherein the second ends of the rods project axially beyond the entire body of the retaining rings such that the second ends are not substantially flush with the outside surface of said other flange and are not contained within the body of the retaining rings.

11. The spool of claim 10, wherein each retaining ring includes an inner peripheral edge engaging the rod and a larger diameter outer peripheral edge axially offset from the inner peripheral edge, the retaining ring having a curved cross section between the inner and outer peripheral edges.

12. The spool of claim 11 wherein the retaining rings are pressed into the flanges forming an indentation therein such that one of the flanges applies an outward axial force to the outer peripheral edge of the retaining ring, the outward axial force being carried by the inner peripheral edge of the retaining ring supported against the outer surface of the rod, the curved cross section of the retaining ring translating the axial force into a radially inward force applied by the inner peripheral edge.

13. The spool of claim 10 further comprising a chamfered surface on the second ends of the rods providing a temporarily seating surface for the retaining rings during initial assembly.

14. The spool of claim 10 wherein the first end of the rod is deformed to provide the enlarged structure.

15. The spool of claim 14 wherein the first end of the rod is bent substantially perpendicular to the rest of the rod.

16. The spool of claim 10 wherein a plurality of retaining rings are pressed on the first ends of the rods to provide the enlarged structure.

17. The spool of claim 10 wherein the flanges are manufactured from a material selected from the group consisting of wood, fiber board, and plastic, the barrel is manufactured from a material selected from the group consisting of wood, fiber board, plastic and metal, and the rods are metal.

18. The spool of claim 10 wherein the rods extend through and substantially fill holes extending through said other flange such that the retaining rings are disposed entirely outside of the holes of the other flange and do not occupy any space of the holes of the other flange.

19. A spool comprising:

first and second flanges in spaced relationship, each flange having a plurality of holes, and a central arbor opening, the holes of the first flange axially aligned with the holes of the second flange, the holes being arranged radially about the central opening;

a plurality of rods, one for each set of axially aligned holes, each rod extending through one set of holes in the flanges, each rod having an enlarged first end sized greater than its corresponding hole in the first flange, and a non-threaded second end projecting from the second flange;

a cylindrical barrel sandwiched transversely between the flanges;

a plurality of retaining rings, one retaining ring axially pressed on the second end of each rod, each retaining ring including an inner peripheral edge engaging the rod and a larger diameter outer peripheral edge axially offset from the inner peripheral edge, the retaining ring having a curved cross section between the inner and outer peripheral edges; and wherein the rods substantially fill the holes of the second flange such that the retaining rings are disposed entirely outside of the holes of the second flange and do not occupy any space of the holes of the second flange.

20. The spool of claim 19 wherein the retaining rings are pressed into the flanges forming an indentation therein such that one of the flanges applies an outward axial force to the outer peripheral edge of the retaining ring, the outward axial force being carried by the inner peripheral edge of the retaining ring supported against the outer surface of the rod, the curved cross section of the retaining ring translating the axial force into a radially inward force applied by the inner peripheral edge.

* * * * *